US009631378B1

(12) United States Patent
Grahl et al.

(10) Patent No.: US 9,631,378 B1
(45) Date of Patent: Apr. 25, 2017

(54) HYDRAULICALLY-DRIVEN CONCRETE FINISHING TROWEL HAVING HYDRAULIC FLUID COOLING SYSTEM AND METHOD

(71) Applicant: Wacker Neuson Production Americas LLC, Menomonee Falls, WI (US)

(72) Inventors: Scott Grahl, Campbellsport, WI (US); Michael Jenkins, Menomonee Falls, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 0 days.

(21) Appl. No.: 15/019,493

(22) Filed: Feb. 9, 2016

(51) Int. Cl.
*E01C 19/42* (2006.01)
*E04F 21/24* (2006.01)
*E01C 19/22* (2006.01)

(52) U.S. Cl.
CPC ..... *E04F 21/247* (2013.01); *E01C 19/22* (2013.01)

(58) Field of Classification Search
CPC ..... E01C 19/42
USPC ..... 404/112
See application file for complete search history.

(56) References Cited

U.S. PATENT DOCUMENTS 4,461,341 A 7/1984 Morrison
4,676,691 A * 6/1987 Morrison ..... E04F 21/248 404/112
5,816,740 A 10/1998 Jaszkowiak
6,048,130 A * 4/2000 Allen ..... E04F 21/247 404/112
6,053,660 A * 4/2000 Allen ..... E04F 21/247 404/112
6,089,786 A * 7/2000 Allen ..... E04F 21/247 404/112
6,106,193 A 8/2000 Allen et al.
7,690,864 B2 * 4/2010 Allen ..... E04F 21/247 404/112
8,360,680 B2 1/2013 Allen et al.
8,388,264 B2 3/2013 Grahl
8,414,219 B2 4/2013 Lickel et al.

OTHER PUBLICATIONS

Allen Engineering Corporation, Operations—Parts Manual HDX750 Hydra-Drive Extreme (HDX) Series Riding Trowel Publication, Dated Jan. 2012 (82 pages).
Wacker Neuson CRT60 Schematic, Dated May 18, 2011 (1 page).
Skid-Steer Schematic With Open-Loop Cooler, Dated Prior to Feb. 1, 2015 (1 page).

* cited by examiner

*Primary Examiner* — Gary Hartmann
(74) *Attorney, Agent, or Firm* — Boyle Fredrickson, S.C.

(57) ABSTRACT

A hydrostatically power self-propelled concrete finishing trowel has at least two coolers in a cooling system of the machine's hydraulic circuit. In the most typical case in which the first cooler is a closed loop oil cooler, the second cooler may take the form of an open loop oil cooler disposed in a flow path connecting one or more low-pressure outlets of the hydrostatic drive system to a reservoir. The closed loop oil cooler actively drops the temperature within the trowel's hydrostatic drive system, while the open loop oil cooler supplements that cooling by reducing the oil temperature in the reservoir.

17 Claims, 7 Drawing Sheets

HYDRAULICALLY-DRIVEN CONCRETE FINISHING TROWEL HAVING HYDRAULIC FLUID COOLING SYSTEM AND METHOD

BACKGROUND OF THE INVENTION

1. Field of the Invention

The invention relates generally to powered concrete finishing trowels and, more particularly, to hydraulically-driven riding trowels. The invention additionally relates to a hydrostatically driven riding trowel having a coolant system for cooling the trowel's hydraulic fluid. The invention additionally relates to a method of operating such a trowel.

2. Description of the Related Art

A variety of powered machines are available for smoothing or otherwise finishing "wet" or uncured concrete. These machines range from simple hand trowels, to walk-behind trowels, to self-propelled riding trowels. Regardless of the mode of operation of such trowels, the power trowels generally include one to three rotor assemblies that rotate relative to the concrete surface.

Riding concrete finishing trowels can finish large sections of concrete more rapidly and efficiently than manually pushed or guided hand-held or walk behind finishing trowels. Riding concrete finishing trowels typically include a frame having a cage that typically encloses two, and sometimes three or more, rotor assemblies. Each rotor assembly includes a driven shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes or hydraulic pumps and motors of the respective rotor assemblies.

The weight of the finishing trowel, including the operator, is transmitted frictionally to the concrete surface by the rotating blades, thereby smoothing the concrete surface. The pitch of individual blades can be altered relative to the driven shafts via operation of a lever and/or linkage system during use of the machine. Such a construction allows the operator to adjust blade pitch during operation of the power trowel. As is commonly understood, blade pitch adjustment alters the pressure applied to the surface being finished by the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

Power trowels traditionally were powered by a gearbox mechanically coupled to an internal combustion engine and were steered manually using a lever assembly coupled to the gearbox assemblies by linkage assemblies. More recently, larger trowels have been introduced that are potentially fatiguing to steer manually. These trowels typically are steered via hydraulically powered actuators responsive to operator manipulation of joysticks. Some of the hydraulically steered trowels are also powered hydraulically via a hydrostatic drive system powered by the machine's internal combustion engine(s). These trowels can be quite large. Some are capable of finishing swaths of 8 feet wide or even 10 feet wide or wider. They are powered by an engine having an output of over 50 hp, and sometimes in excess of 70 hp, and weigh more than 2,500 lbs.

The hydrostatic drive system of a riding trowel typically includes a cooling system for cooling the hydraulic fluid or oil being pumped through the drive system and the other hydraulically actuated components of the system. (The terms "hydraulic fluid", "fluid", and "oil" are used interchangeably throughout this disclosure). Some hydrostatically driven trowels employ a closed loop cooling system including a cooler in the closed loop between the drive motor(s) and drive pump(s) of the hydrostatic drive system. This is in contrast to the vast majority of hydrostatic drives that employ a cooler in an open loop branch of the hydraulic circuit. These riding trowels can be cooled via a closed loop cooler, despite the fact that the pressure at the outlet of the drive pump is far too high to be accommodated by known oil coolers suitable for use in equipment of this type, because fluid flow in the closed loop circuit is unidirectional. The low pressure or "charge" side of the circuit thus never experiences "load" pressure. That side of the circuit instead only reaches "charge" pressure, which is sufficiently low to be tolerated by some oil coolers. The resulting cooling system actively cools the highest flow as well as typically the hottest oil in the circuit.

However, the inventors have discovered that a closed loop cooling circuit alone may provide insufficient cooling of some larger hydrostatically driven riding trowels, particularly if the machine is operated for prolonged periods of time under extreme operating conditions such as under high ambient temperatures and/or on a surface having a high coefficient of sliding friction. Specifically, the inventors have discovered that the high duty cycles under heavy loads experienced by the hydrostatic drive system of a riding trowel can increase the temperature in the reservoir due to hot oil leakage from the pumps and motors. As there is no cooling in the open loop, the reservoir temperatures can rise to above 93° C. (200° F.). Hydraulic fluid viscosity drops with temperature, reducing the volumetric efficiencies of the system's charge pump and reducing the lubrication boundary layer for the parts to slide against each other in the tandem pump. The inventors have discovered that the fluid viscosity can drop so much in a power trowel having a single cooler that cavitation can occur. Accelerated piston shoe wear and even failure in the axial piston pump and other failures may occur. The inventors thus have discovered a need to prevent detrimental effects to a hydrostatically driven riding trowel that could result from overheating of the system's hydraulic fluid.

This need theoretically could be met by providing a larger oil cooler in the system's closed loop circuit. However, no known oil coolers on the market today have been found to be suitable to provide adequate cooling of the existing hydrostatic drive system during prolonged operation under extreme operating conditions in which the oil temperature in the reservoir is undesirably high.

Oil overheating and resultant viscosity drop also theoretically could be avoided by providing larger-capacity drive pumps and drive motors and otherwise "sizing up" components of the trowel's hydrostatic drive system. However, such a "sizing up" would add considerable cost to the overall system. It also would add weight, which is detrimental because adding weight to a riding trowel increases the time the concrete must cure before a finishing operation can commence. For example, a machine that currently weighs 2,700 lbs. that is modified to have larger-capacity pumps and hydraulic motors likely would weigh in excess of 3,300 lbs.

Therefore, the need remains to provide adequate cooling of hydraulic fluid in a hydrostatic drive system of a hydrostatically driven concrete finishing trowel.

The need additionally exists to provide adequate hydraulic fluid cooling in a hydrostatically driven riding power trowel that does not significantly increase the cost or weight of the machine.

SUMMARY OF THE INVENTION

In accordance with one aspect of the invention, one or more of the above-identified needs is met by providing at least two coolers in a cooling system of a hydrostatically driven riding concrete finishing trowel. In the most typical case in which the first or primary cooler is a closed loop cooler, the second or auxiliary cooler may take the form of an open loop cooler disposed in a flow path connecting one or more low-pressure outlets of the hydrostatic drive system to a reservoir. The closed loop cooler actively drops the temperature of the oil within the hydrostatic drive system. The cooling of the open loop cooler supplements the cooling of the closed loop cooler by reducing oil temperature in the reservoir, thus allowing the drive pump(s) and motor(s) to operate at continuous load cycles not previously considered attainable.

In one possible configuration, the machine includes a frame, at least first and second rotor assemblies extending downwardly from the frame, each of the rotor assemblies having a shaft that supports a plurality of blades, an engine, and a hydraulic circuit including a reservoir and a hydrostatic drive system. The hydrostatic drive system is coupled to the engine, to the rotor assemblies, and to the reservoir. It includes a drive motor that is coupled to at least one of the rotor assemblies, a drive pump that is driven by the engine and that delivers pressurized fluid to the drive motor, and a charge pump that is connected to the reservoir and that delivers hydraulic fluid to the drive pump. First and second coolers such as oil coolers cool hydraulic fluid flowing through the hydrostatic drive system.

The first cooler may be a closed loop oil cooler located in a flow path connecting an outlet of the drive motor to an inlet of the drive pump, and the second cooler may be an open loop cooler in a flow path connecting the hydrostatic drive system to the reservoir.

The hydraulic circuit may additionally include an auxiliary pump and an auxiliary control circuit that selectively couples hydraulically actuated devices of the trowel to the auxiliary pump and to a drain flow path. At least a portion of the drain flow path may be fluidically coupled to an inlet of the open loop oil cooler.

A bypass/case drain valve may be provided to permit hydraulic fluid flowing out of the hydrostatic drive system to bypass the open loop oil cooler at startup when case pressure is non-negligible and fluid temperature is low.

In accordance with another aspect of the invention, a method of operating a hydrostatically driven riding concrete finishing machine is provided.

In one implementation, the method is carried out on a concrete finishing machine having an engine and first and second rotatable rotor assemblies that support the concrete finishing machine on a surface to be finished. The method comprises driving a drive pump of a hydrostatic drive system via operation of the engine, delivering pressurized hydraulic fluid to a drive motor of the hydrostatic drive system from the drive pump, thereby causing the drive motor to drive at least one of the rotor assemblies to rotate, and delivering hydraulic fluid from the drive motor to the drive pump. The method additionally comprises draining leakage hydraulic fluid from the hydrostatic drive system, and pumping make-up hydraulic fluid to the hydrostatic drive system. The method further includes cooling hydraulic fluid flowing through the hydrostatic drive system in first and second coolers.

The cooling step may maintain the temperature of hydraulic fluid within the hydrostatic drive system beneath 200° F. throughout at least substantially an entire operating range of the concrete finishing machine.

The cooling step may comprise cooling hydraulic fluid within a closed loop circuit of the hydrostatic drive system via the first cooler and cooling hydraulic fluid drained from the hydrostatic drive system via the second cooler.

The method may additionally include controlling hydraulic fluid flow to and from hydraulically actuated devices of the concrete finishing machine via operation of an auxiliary hydraulic circuit. In this case, hydraulic fluid flowing from the auxiliary hydraulic circuit may be cooled in the second cooler.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Exemplary embodiments of the invention are illustrated in the accompanying drawings in which like reference numerals represent like parts throughout, and in which.

DETAILED DESCRIPTION OF THE PREFERRED EMBODIMENTS

Figure 1A:
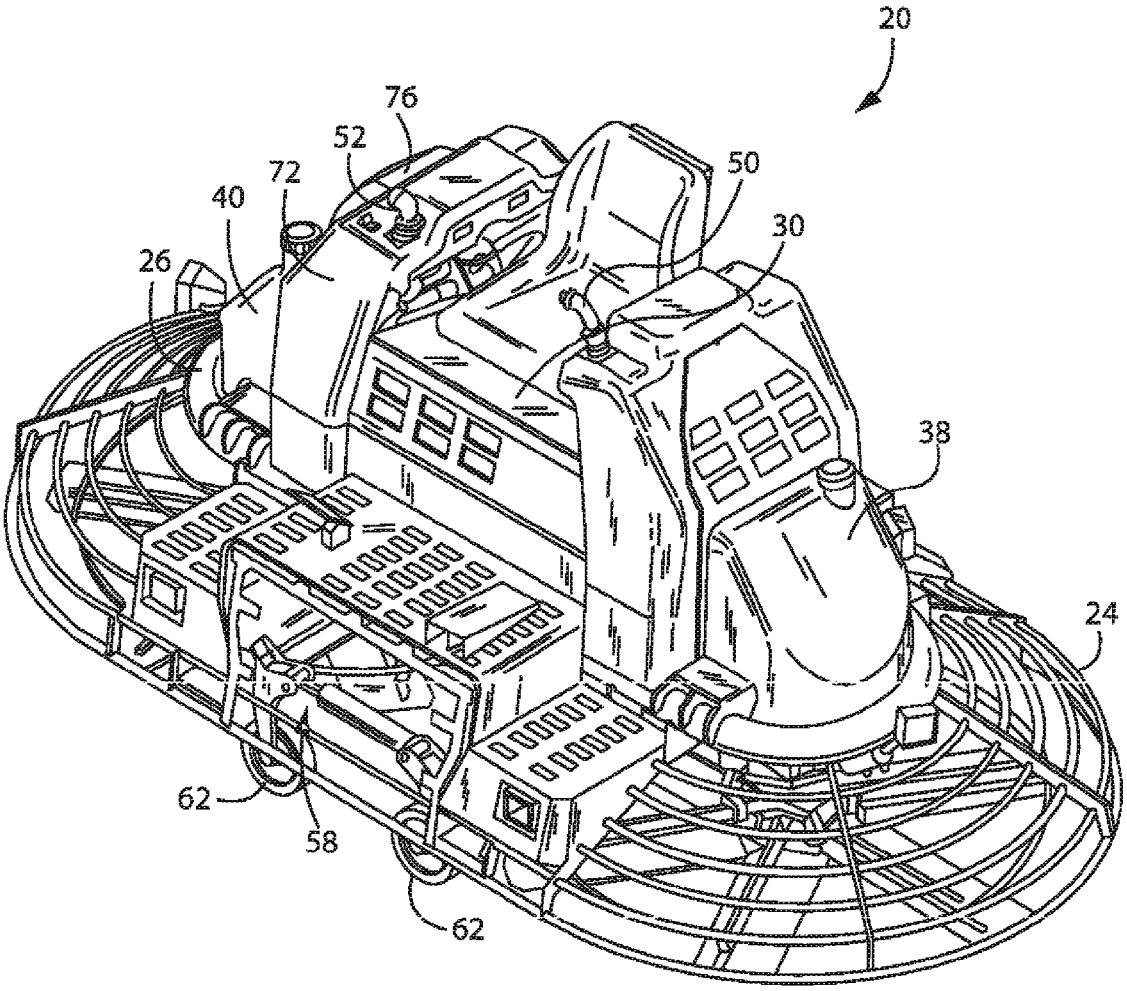
FIG. 1A is an isometric view of a hydrostatically driven concrete finishing trowel equipped with an oil cooling system according to an embodiment of the present invention.
Figure 1B:
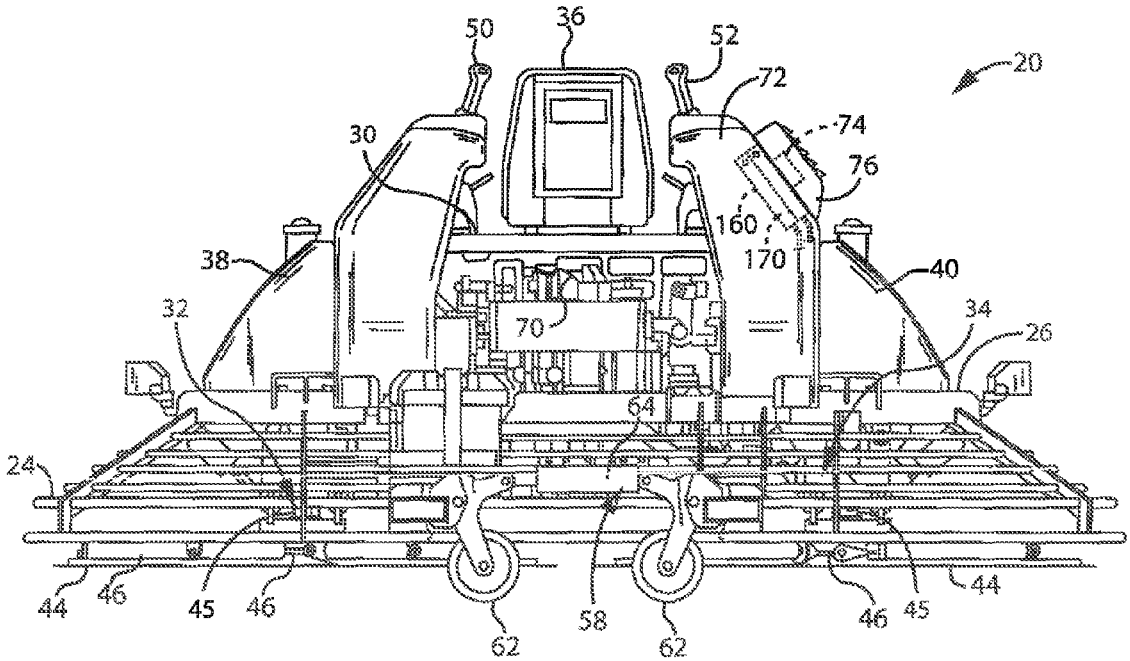
FIG. 1B is a rear elevation view of the trowel of FIG. 1A.

FIGS. 1A and 1B show a self-propelled hydraulically driven riding concrete finishing trowel or "power trowel" 20 equipped with a hydraulic circuit 100 (FIGS. 2A and 2B) having a fluid cooling system constructed according to a preferred embodiment of the present invention. The power trowel 20 includes as its major components a protective cage 24 extending downwardly from a rigid metallic frame 26, an upper deck 28 mounted on frame 26, an operator's platform or pedestal 30 provided on the deck 28, and right and left rotor assemblies 32, 34, respectively, extending downwardly from frame 26 and supporting the trowel 20 on the surface to be finished. The rotor assemblies 32 and 34 rotate towards the operator, or counterclockwise and clockwise, respectively, to perform a finishing operation. Cage 24 is positioned at the outer perimeter of trowel 20 and extends downwardly from frame 26 to the vicinity of the surface to be finished. Cage 24 generally defines a footprint of trowel 20. The pedestal 30 is positioned generally longitudinally centrally on frame 26 at a rear portion thereof and supports operator's seat 36. A fuel tank 38 is disposed adjacent the left side of pedestal 30, and a water retardant tank 40 is disposed on the right side of pedestal 30. Each rotor assembly 32, 34 includes a plurality of circumferentially-spaced blades 44 supported on a driven shaft 45 (FIG. 1B) via radial support arms 46 and extending radially outwardly from the bottom end of the driven shaft 45 so as to rest on the concrete surface. Blade pitch can be adjusted via hydraulic cylinders 203, 209 (FIG. 2B).

Still referring to FIGS. 1A and 1B, trowel 20 additionally includes a steering system in the form of one, and preferably two, joysticks 50, 52 that steer trowel 20 by tilting the driven shafts 45 of the rotor assemblies 32, 34 of trowel 20. Joysticks 50, 52 are operationally coupled to the respective rotor assemblies 32, 34 such that manipulation of joysticks 50, 52 manipulates the position of rotor assemblies 32, 34 relative to the frame 26. Specifically, as is typical of riding concrete finishing trowels of this type, trowel 20 is steered by tilting a portion or all of each of the rotor assemblies 32 and 34 so that the rotation of the blades 44 generates horizontal forces that propel trowel 20. The steering direction is generally perpendicular to the direction of rotor assembly tilt. Hence, side-to-side and fore-and-aft rotor assembly tilting causes trowel 20 to move forward/reverse and left/right, respectively. As described in U.S. Pat. No. 7,775,740 to Berritta, the disclosure of which is incorporated herein, the most expeditious way to effect the tilting required for steering control is by tilting the entire rotor assemblies 32 and 34 using hydraulic cylinders 214, 220, and 226 (FIG. 2B).

The trowel 20 can be transported around the worksite by front and rear wheel assemblies 58 located generally centrally of the frame 20 and spaced longitudinally from one another so as to be positioned in front of and behind the operator's seat 36, respectively. Each wheel assembly includes two laterally spaced wheels 60 and 62 that are coupled to one another by a hydraulic cylinder 64 that can be actuated to raise and lower both wheels 60, 62 in unison. Further details of an acceptable wheel assembly and its operation can be ascertained from U.S. Pat. No. 8,414,219, the subject matter of which is incorporated herein by reference in its entirety.

Both rotor assemblies 32 and 34 are driven indirectly by an engine (shown highly schematically at 70 in FIG. 1B). A protective shroud 72 is mounted on the frame 26 between the fuel tank 38 and the water retardant tank 40 so as to encase the engine 70 and most other hydraulic and mechanical components of the trowel 20. A portion of that shroud 72 is shown removed from FIG. 1B. Also protected by the shroud 72 are closed loop and open loop coolers 160 and 170 of the hydraulic cooling system 100. Cooling air is forced over these coolers by a fan 74 protected by a fan guard 76 mounted on a side surface of the shroud 72.

Figure 2A:
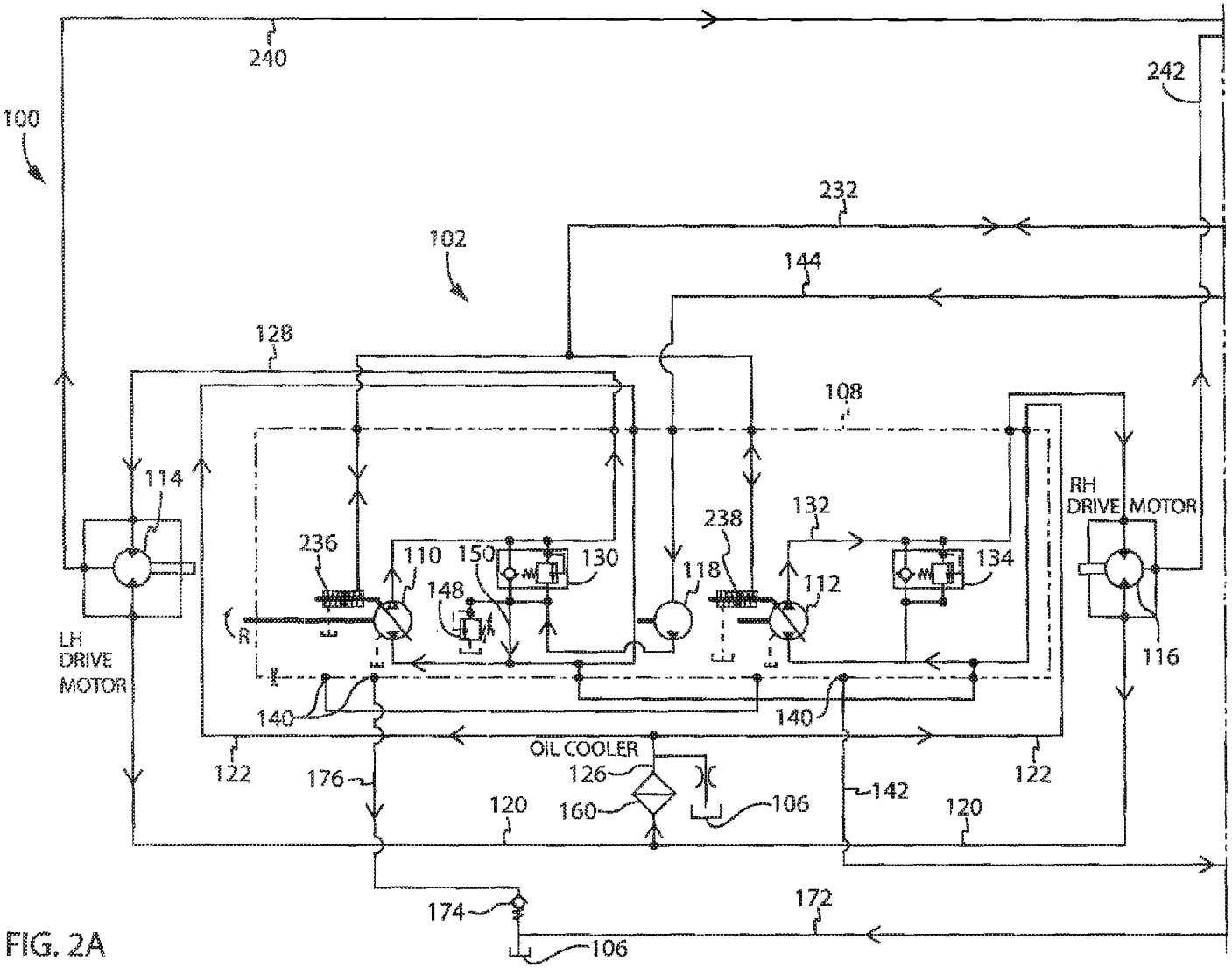
FIGS. 2A and 2B collectively schematically illustrate a hydraulic circuit of the trowel of FIGS. 1 and 1B.
Figure 2B:
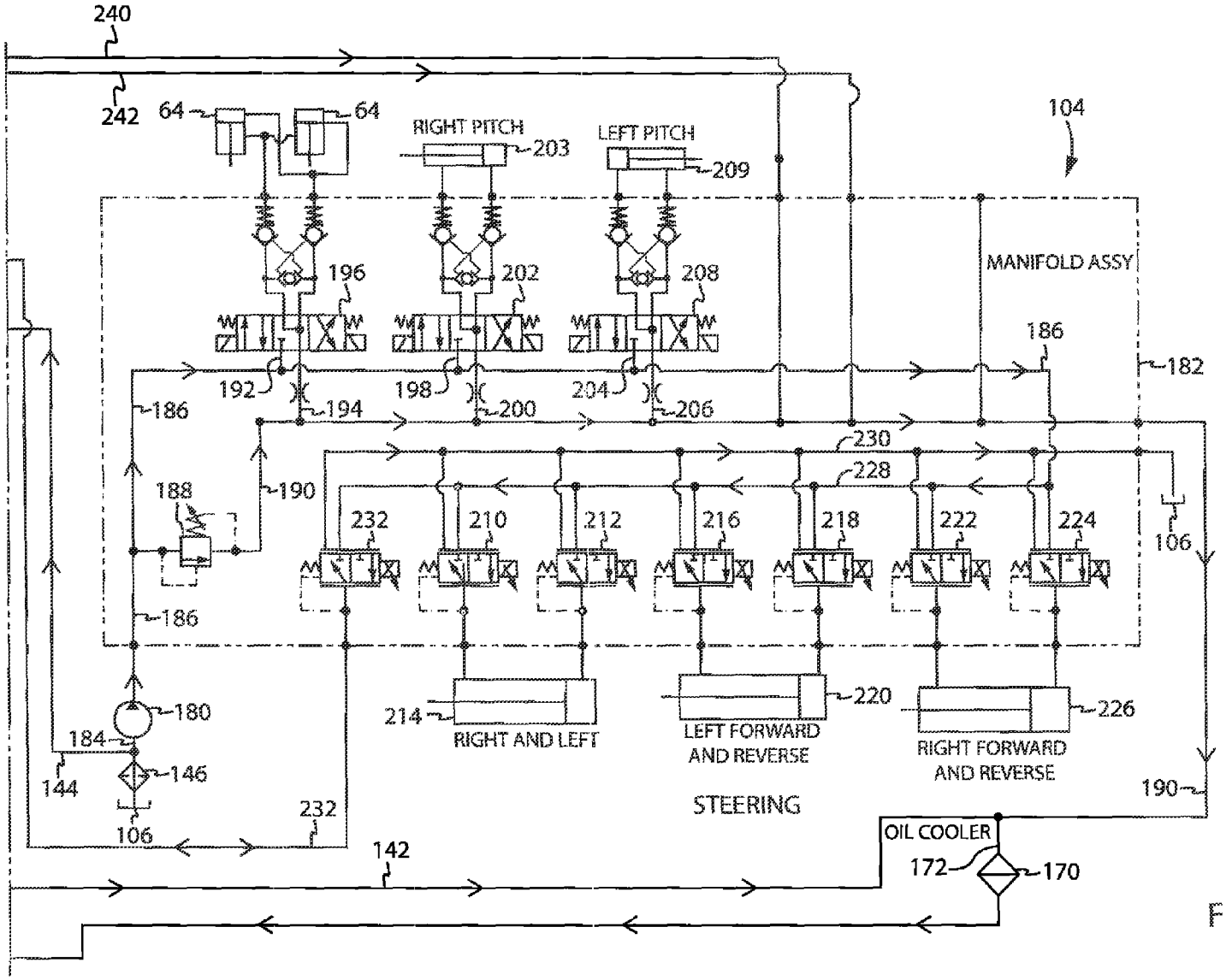

Referring now to FIGS. 2A and 2B, the hydraulic circuit 100 includes two major sub-circuits, namely, a hydrostatic sub-circuit or "hydrostatic drive system" 102 and an auxiliary circuit or "control circuit" 104. The circuit 100 includes a reservoir 106 as well as a number of pumps, valves, motors, and other devices connected to one another and to the reservoir 106 by "flow paths." Any or all of these flow paths could take the form of any or all of hoses, lines, or passages in a valve body, manifold, or housing, or other structures permitting fluid flow in a confined manner. The reservoir 106 may take the form of one or more tanks that may or may not be in fluid communication with one another. The hydrostatic drive system 102 drives the rotor assemblies 32, 34 to rotate as described above. The control circuit 104 actuates hydraulic cylinders controlling the various hydraulically-actuated components of the machine 20. Each sub-circuit or system 102 and 104 will be discussed in turn.

Still referring to FIGS. 2A and 2B, the hydrostatic drive system 102 is a closed loop system having at least one drive pump and at least one drive motor. A casing 108 houses the drive pump(s) and other components described below. The illustrated embodiment of the hydrostatic drive system 102 includes dedicated left and right drive assemblies having respective left and ride drive pumps 110 and 112 coupled to left and right drive motors 114 and 116, respectively. The drive pumps 110 and 112 are supplied with makeup fluid via a charge pump 118 that also is housed in casing 108 and that that replaces fluid that leaks from the pumps 110, 112, and 118. All three pumps 110, 112, and 118 are driven by the engine 70 via a common driven shaft or a combination of shafts coupled to the driven shaft.

The drive systems for the left and right rotor assemblies 32 and 34 are generally mirror images of one another. The left drive pump 110 and the left drive motor 114 are hydraulically coupled to one another in a closed loop circuit. Specifically, the left drive pump 110 has a low-pressure inlet coupled to an outlet of the left drive motor 114 via a shared low pressure flow path that includes upstream and downstream portions 120 and 124 which are coupled to one another by a connecting portion 126. The left drive pump 110 also has a high-pressure outlet coupled to the inlet of the left drive motor 114 by a dedicated high-pressure flow path 128. The pressure in that flow path 128 is maintained at a desired value by a relief valve 130. That value typically is above 3,000 psi and is more typically between 5,000 and 6,000 psi.

The drive system for the right rotor assembly 34 similarly includes the right drive pump 112 and the right drive motor 116, which are hydraulically coupled to one another in a closed loop circuit. Specifically, the right drive pump 112 includes a low-pressure inlet coupled to the outlet of the right drive motor 116 by the downstream portion 122 of the shared low pressure flow path. The high-pressure outlet of the right drive pump 112 is coupled to the low pressure inlet of the right drive motor 116 by a high pressure flow path 132. Pressure in that flow path 132 is maintained at a designated value by a relief valve 134. That value may be, but is not necessarily, the same as the value maintained by the relief valve 130 for the left drive pump 110.

As is typically the case in hydrostatic drive systems, the hydrostatic drive system 102 is not truly closed loop but, instead, must be continuously charged with makeup fluid from the charge pump 118 while leakage fluid flows to the reservoir 106. The leakage fluid is directed to the reservoir 106 through one or more case drains 140 in the casing 108, and thence through a drain flow path 142 having an inlet coupled to the case drains 140 and an outlet coupled to the reservoir 106. The charge pump 118 has an inlet connected to the reservoir 106 via an inlet flow path 144 and an outlet connected to a relief valve 148 that sets the charge pressure for the left and right drive pumps 110 and 112. That charge pressure typically is between 200 and 500 psi and more typically of about 300 psi. The outlet of the relief valve 148 communicates with the downstream portion 122 of the shared low pressure flow path by a feed flow path 150.

As should be apparent from the foregoing, the hydrostatic drive system 102 is unidirectional so that one portion of the hydraulic circuit is always at a relatively high "load" pressure and one portion is always at a relatively low "charge" pressure. This characteristic permits the inclusion of an oil cooler 160 in the low-pressure or charge portion of the hydraulic drive system 102. In this embodiment, that oil cooler 160 is located in the connecting portion 126 of the shared low pressure flow path leading from the outlets of the drive motors 114 and 116 to the inlets of the pumps 110 and 112. The oil cooler 160 may, for example, comprise a radiator-type fluid-to-air heat exchanger. An acceptable oil cooler is available commercially from AKG Thermal Systems of Mebane, N.C. (USA) under the model No. 3703.927.1000. The AKG cooler is an air-cooled cooler rated for pressures of up to 360 psi. The cooler 160 provides a temperature drop (ΔT) at maximum fluid flow rates through the cooler 160 of about 8° F.

In order to provide supplemental cooling and prevent undesired drops in oil viscosity arising from overheating of the oil, a second oil cooler 170 is provided in the cooling system of the hydraulic circuit 100. While it is conceivable that the cooler 170 could be formed somewhere in the closed loop circuit, the oil cooler of the exemplary embodiment is provided in an open loop circuit connecting the drain flow path 142 to the reservoir 106. Inserting the cooler 170 in or downstream of flow path 142 is beneficial because the fluid entering the drain flow path 142 from the case drains 140 in the casing 180 typically is the hottest fluid in the hydraulic circuit 100 from which one receives the most efficient cooling. The open loop oil cooler 170, like the closed loop oil cooler 160, comprises a radiator-type fluid-to-air heat exchanger. It is located in a combined drain flow path 172 connecting the drain flow path 142 and an auxiliary drain path 190 (described below) to the reservoir 106. An acceptable oil cooler is a commercially available from AKG Thermal Systems of Mebane, N.C. (USA) under the model No. 3703.927.1000. The AKG cooler is a fan-cooled cooler rated for pressures of up to 360 psi. The cooler provides a temperature drop (ΔT) at maximum fluid flow rates through the cooler of 5° F.

The open loop oil cooler 170 is neither required nor even desired at start-up under cold-weather operating conditions, when the oil viscosity is higher than optimal. In order to bleed off case pressure in the system at startup and permit the oil to rapidly warm, a bypass/case drain valve 174 is provided in the circuit 100 to permit oil to bypass the open loop oil cooler 170 under low-temperature operating conditions when the pressure in the casing 108 is non-negligible. In the illustrated embodiment, the bypass valve 174 is a check valve provided in a bypass flow path 176 connecting one of the case drains 140 of the casing 108 to the reservoir 106 in bypass of the open loop oil cooler 170. The valve 174 is set to close and prevent bypass flow at pressures below about 25 psi, which typically exist at oil temperatures above about 50° F.

Referring primarily to FIG. 2B, the auxiliary or control circuit 104 includes an auxiliary pump 180 and a control manifold assembly 182. The control manifold assembly 182 contains valving controlling fluid flow between the auxiliary pump 180, various hydraulic cylinders and other devices of the power trowel 20, and the reservoir 106. The auxiliary pump 180 may be a gear pump driven, for example, by a power takeoff or other secondary drive source of the engine 70. The auxiliary pump 180 has an inlet coupled to the reservoir 106 via a feed flow path 184 and an outlet coupled to a supply flow path 186. A pressure relief valve 188 is provided in the supply flow path 186 to maintain a pressure in the flow path 186 of, for example, 800 psi. Excess pressure from the relief valve 188 is directed to the combined flow path 172 and thence to the low pressure cooler 170 via an auxiliary drain flow path 190 located within and flowing from the control manifold assembly 182.

Still referring primarily to FIG. 2B, a first branch 192 of the supply flow path 186 and a first branch 194 of the auxiliary flow path 190 are connected to a first solenoid actuated two-way/three position valve 196. Depending on which of the three positions it is set in, valve 196 selectively couples the respective first and second ends of the wheel lift cylinders 64 to the auxiliary pump 180 and the reservoir 106, respectively, and also selectively prevents fluid flow to or from the cylinders 64 to lock the wheels in place. Similarly, second branch flow paths 198 and 200 of the supply and auxiliary drain flow paths 186 and 190 are connected to a two-way, three-position valve 202. Valve 202 is coupled to the right pitch adjustment cylinder 203 for the right rotor assembly 34 to permit blade pitch of the right rotor assembly 34 to be adjusted depending on the direction of fluid flow through the cylinder 203 and to hold the blade pitch at a given angle by preventing fluid flow through the cylinder 203. Third branch flow paths 204 and 206 of the supply and auxiliary drain flow paths 186 and 190 are connected to a two-way, three-position valve 208. Valve 208 is coupled to the left pitch adjustment cylinder 209 for the left rotor assembly 32 to permit blade pitch of the left rotor assembly 32 to be adjusted depending on the direction of fluid flow through the cylinder 209 and to hold the blade pitch at a given angle by preventing fluid flow through the cylinder 209. Other standard shuttle and check valves associated with the cylinders 64, 203, and 209 are standard, and a description will be omitted for the sake of conciseness.

Still referring primarily to FIG. 2B, the manifold assembly 182 of auxiliary sub-circuit 104 additionally houses several solenoid actuated two-way, two-position valves controlling fluid flow to and from double acting hydraulic cylinders controlling the tilt of the rotor assemblies 32 and 34. Those valves include first and second valves 210 and 212 connected to the respective sides of a right/left cylinder 214 associated with the right rotor assembly 34; third and fourth valves 216 and 218 coupled to the respective sides of a forward/reverse cylinder 220 associated with the left rotor assembly 32; and fifth and sixth valves 222 and 224 coupled to the respective sides of a forward/reverse cylinder 226 associated with the right rotor assembly 34. All of these valves, as well as the manner in which they are operated to steer the trowel 20, are known in the art. Each valve 210, 212, 216, 218, 222, and 224 has a high pressure inlet port connected to a branch 228 of the supply flow path 186, a control port coupled to the associated cylinder 214, 220, or 226, and a drain port connected to a branch of a secondary drain path 230. This secondary drain path 230 is coupled directly to the reservoir 106 in bypass of the open loop oil cooler 170 rather than being coupled to the auxiliary drain path 190 because the inventors discovered that fluid flow through the open loop oil cooler 170 can produce flow lags under some operating conditions that undesirably diminish the responsiveness of the steering system.

Still referring primarily to FIG. 2B, the auxiliary circuit 104 further comprises another solenoid actuated two-way, two-position valve or hydrostatic displacement control valve 232 having an inlet port coupled to branch path 228 of the supply flow path 186, an outlet port coupled to the secondary drain path 230, and a control port coupled to a control flow path 234. The control flow path 234 is coupled to left and right servo pistons 236 and 238 (FIG. 2A) associated with the left and right drive pumps 110 and 112. Operation of valve 232 strokes the swash plates of drive pumps 110 and 112 to control the fluid flow rate through the drive pumps 110 and 112 and drive motors 114 and 116 and, thus, to control rotor speed.

Finally, first and second drive motor drain paths 240 and 242 drain leakage fluid from the left and right drive motors 114 and 116, respectively, to the auxiliary drain flow path 190.

In operation of an exemplary machine by a 74 hp diesel engine and exhibiting a circuit efficiency of approximately 80%, 10-15 hp is converted into heat. Some of this heat is transferred to the hydraulic fluid, causing the fluid temperature in the hydraulic circuit 100 to rise. The fluid flow splits between the open and closed loop circuits of the hydraulic circuit 100. For example, the drive pumps 110 and 112 may generate a flow of approximately 28 gpm through the two drive motors 114 and 116, while the auxiliary pump 180 may generate a flow of approximately 6 gpm through the control manifold assembly 182. The charge pump 118 also generates a flow of approximately 6 gpm, exchanging fluid between the open and closed loops of circuit 100 to make up for the leakage flow from the hydrostatic power system 102. This charge pump 118 return flow is directed through drain path 142 to combine with the auxiliary pump return flow from auxiliary drain flow path 190. Therefore, the closed loop oil cooler 160 experiences a flow rate of approximately 28 gpm, and the open loop cooler 170 experiences a flow rate of approximately 12 gpm. Fluid is cooled in both coolers 160 and 170. That cooling, coupled with natural convection in the reservoir 106, transfers enough heat from the hydraulic fluid to maintain the fluid temperature in all portions of the hydraulic circuit 100 at an acceptably low level, preferably below 100° C. (212° F.) and more preferably below 93° C. (200° F.).

Figure 3:
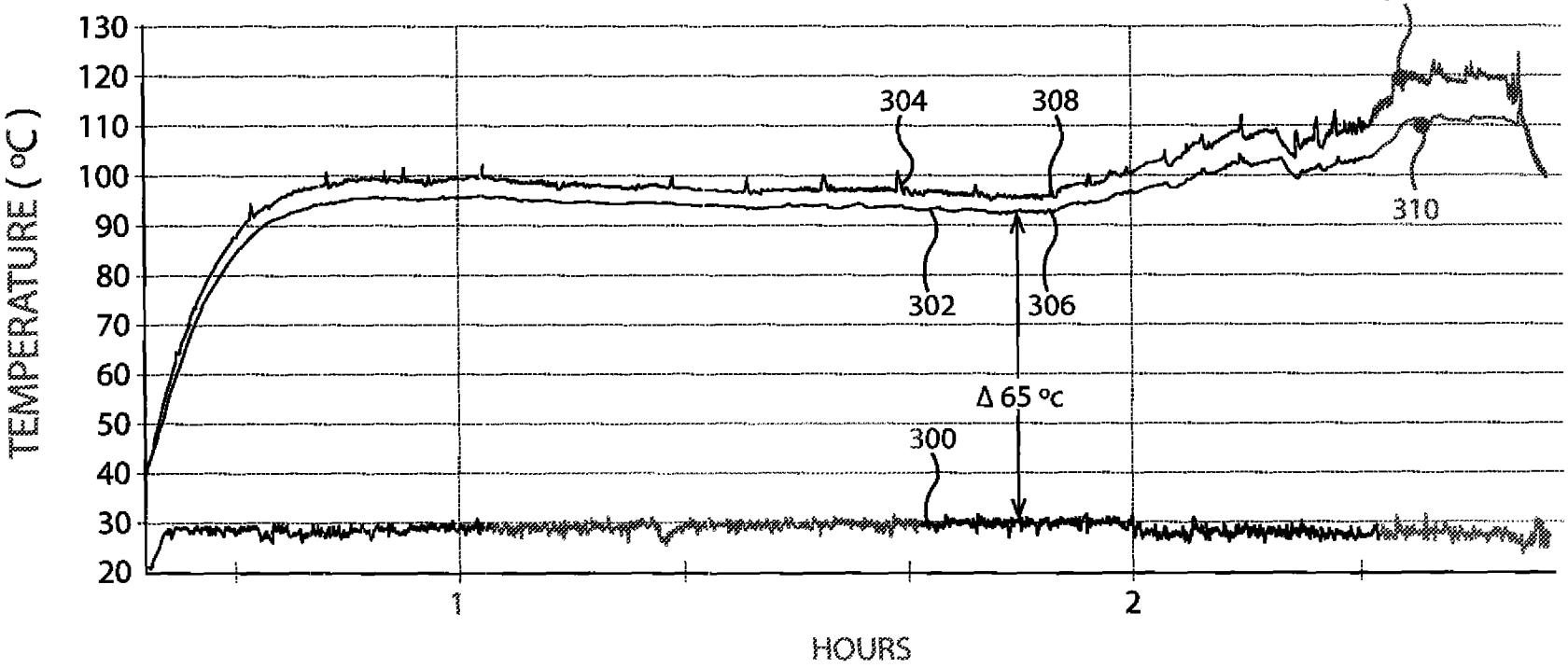
FIG. 3 PRIOR ART
FIG. 3 is a family of curves illustrating temperatures vs. time at several locations in a hydraulic circuit of a prior art driven trowel, appropriately labeled "PRIOR ART"

The benefits of incorporating both coolers 160 and 170 into the hydraulic circuit 100 as described above can be appreciated by comparing FIG. 3 to FIG. 4. FIG. 3, appropriately labeled "PRIOR ART", consists of a family of curves plotting temperature versus time during operation of a Wacker Neuson Model CRT 60 hydrostatically driven power trowel cooled by a single closed loop oil cooler and lacking an open loop oil cooler as described above. Curve 300 designates ambient air temperature. With occasionally reference to FIGS. 2A and 2B, curve 302 designates the temperature in the reservoir 106 as measured in the feed flow path leading from the reservoir 106 to the auxiliary pump 180. Curve 304 designates the temperature at one of the case drains leading to the drain flow path 142 and approximates temperature in the hydrostatic drive system 102.

As one would expect, hydraulic fluid temperatures in the reservoir 106 and in the hydrostatic drive system 102 initially increase sharply from at or near ambient temperature to an operating temperature. The steady state reservoir temperature is on the neighborhood of 90-95° C. (194-203° F.). This temperature, being about 65° C. (145° F.) above ambient, is relatively high but acceptable. Fluid temperature remains at or near that operating temperature during normal operation of the trowel. However, after a prolonged period of operation at high duty cycles beginning at about points 306 and 308 on curves 302 and 304 in FIG. 3, the fluid temperatures in both the reservoir and the hydrostatic drive system begin to rise because the closed loop oil cooler is incapable of providing adequate oil cooling. Eventually, the temperature of the oil increases to above 100° C. (212° F.) and even 110° C. (230° F.) at points 310 and 312. As will be demonstrated below in conjunction with the discussion of FIG. 5, oil viscosity at these temperatures drops well below the optimum range, potentially resulting in cavitation and resultant damage to the pumps and other components of the hydrostatic power system.

Figure 4:
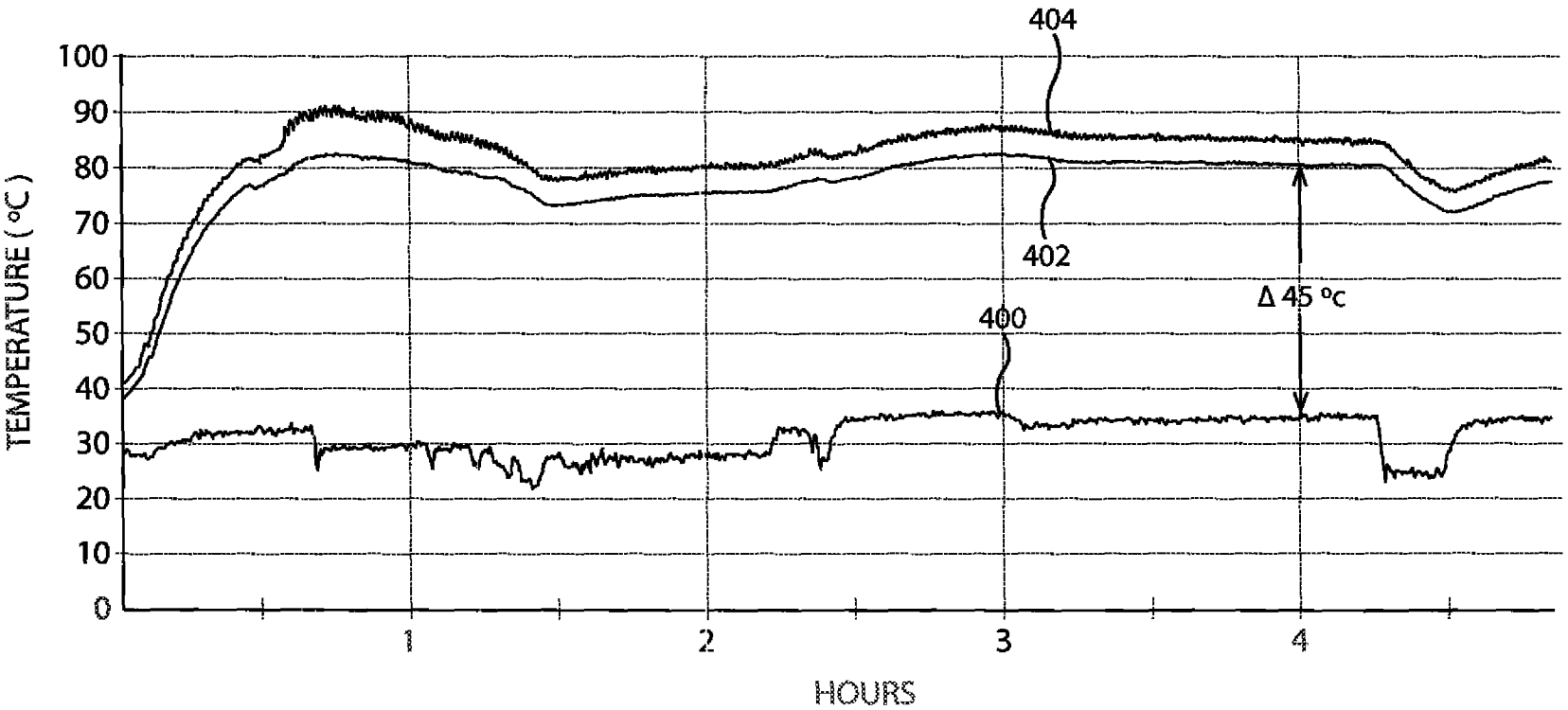
FIG. 4 is a family of curves illustrating temperatures vs. time at locations in the hydraulic circuit of FIGS. 2A and 2B.

In contrast, the family of curves of FIG. 4 illustrates oil temperature versus time in a riding trowel 20 that includes the afore-described open loop oil cooler 170 and the other components described above in connection with FIGS. 1A-2B. As in FIG. 3, curve 400 designates ambient temperature, and curves 402 and 404 designate oil temperature in the reservoir 106 or tank outlet and at one of the case drains 140. Curves 402 and 404 of FIG. 4 indicate that oil temperature both in the reservoir 106 and in the hydrostatic drive system 102 initially increased rapidly from near ambient to a generally steady-state operating temperature. That operating temperature never exceeded about 81° C. (180° F.) at the reservoir outlet and about 85° C. (185° F.) at the case drain 140. The ($\Delta T$) between the ambient temperature and the reservoir temperature thus remained at no more than about 45° C. (113° F.), which is lower than that experienced even under steady state operation of the prior art system. The latter portions of the curves 402 and 404 reveal that the oil temperatures in the hydraulic circuit 100 never exceeded those relatively low temperatures even after prolonged operation at duty cycles typically experienced by trowels of this type. Indeed, while the prior art system experienced oil overheating after less than three hours of operation, the power trowel 20 incorporating the open loop cooler 170 did not experience overheating after five hours of continuous operation under comparable ambient operating conditions. Oil temperature actually decreased late in the tested cycle due to a decrease in ambient temperature.

Figure 5:
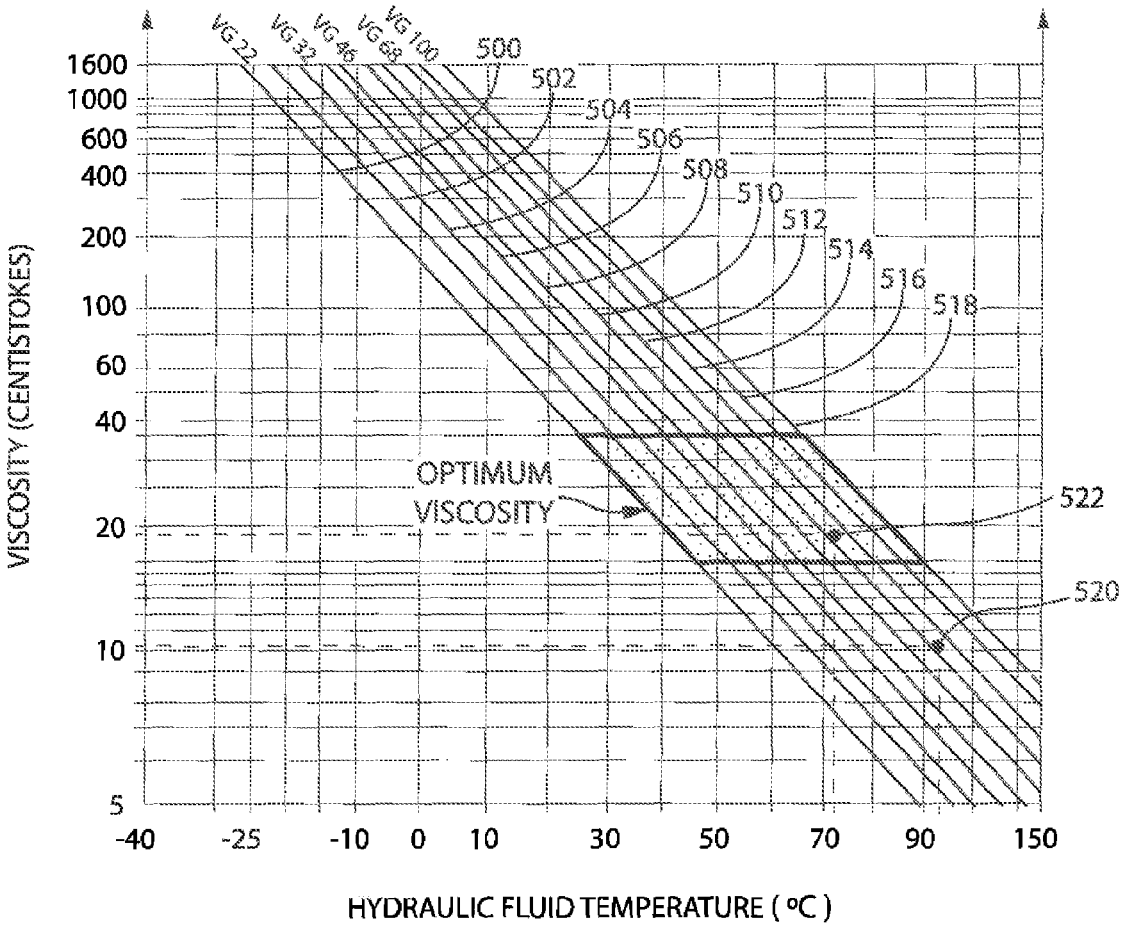
FIG. 5 is a family of curves of viscosity vs. temperature for various hydraulic fluids.

Turning now to FIG. 5, the practical benefits of maintaining hydraulic fluid in the hydrostatic drive system 102 at a relatively low temperature can be appreciated. The curves 500 through 518 plot viscosity versus temperature for a variety of hydraulic fluids designated by viscosity. The shaded region indicates that each of these fluids has an optimum viscosity range that varies with the selected fluid. The tested fluid had a VG 68 value designated by curve 512 in FIG. 5. VG 68 has an optimum viscosity range of about 19-38 centistokes. As designated by point 520 at tank outlet temperatures in excess of 100° C., as were experienced in testing the prior art system, the hydraulic fluid had a viscosity of only about 11 centistokes. In contrast, in a system equipped with an open loop oil cooler 170 in which the tank outlet temperature never exceeded more than about 81° C., the viscosity of the oil never dropped below about 19 centistokes as seen at point 522, which is well within the optimum viscosity range of the VG 68 grade oil employed in the hydraulic circuit 100.

It is to be appreciated that many changes and modifications could be made to the invention without departing from the spirit thereof. For example, it is conceivable that one or more additional coolers could be provided in the circuit 100. It is also conceivable that additional drive motors and drive pumps could be provided, particularly in a system having more than two rotor assemblies. Hence, while some of these changes are discussed herein, other changes will become apparent from the appended claims. It is intended that all such changes and/or modifications be incorporated in the appending claims.

What is claimed is:

1. A concrete finishing trowel comprising:

a frame;

at least first and second rotor assemblies extending downwardly from the frame, each of the rotor assemblies having a shaft that supports a plurality of blades;

an engine; and a hydraulic circuit including a reservoir and a hydrostatic drive system that is coupled to the engine, to the rotor assemblies, and to the reservoir, the hydrostatic drive system comprising including a hydraulic motor that is coupled to at least one of the rotor assemblies, a drive pump that is driven by the engine and that delivers pressurized fluid to the hydraulic motor, and a charge pump that is connected to the reservoir and that delivers hydraulic fluid to the drive pump, wherein the hydraulic circuit further comprises first and second coolers that cool hydraulic fluid flowing through the hydrostatic drive system, wherein the first cooler is a closed loop cooler located in a flow path connecting an outlet of the motor to an inlet of the drive pump, and the second cooler is an open loop cooler in a flow path connecting the hydrostatic drive system to the reservoir.

2. The concrete finishing trowel of claim 1, wherein each of the coolers is a hydraulic fluid to air heat exchanger.

3. The concrete finishing trowel of claim 1, wherein the hydraulic motor is a first drive motor coupled to the first rotor assembly, the drive pump is a first drive pump that delivers pressurized fluid to the first drive motor, the hydrostatic drive system further comprises a second drive motor coupled to the second rotor assembly and a second drive pump that delivers pressurized fluid to the second drive motor, the charge pump delivers hydraulic fluid to both the first and second drive pumps, and wherein the closed loop cooler is in a flow path connecting an outlet of each of the driver motors to an inlet of each of the drive pumps.

4. The concrete finishing machine of claim 1, further comprising an auxiliary pump and an auxiliary circuit that selectively couples hydraulically actuated devices of the concrete finishing trowel to the auxiliary pump and to a drain flow path, and wherein the drain flow path is fluidically coupled to an inlet of the open loop cooler.

5. The concrete finishing machine of claim 4, wherein the auxiliary circuit is hydraulically coupled to at least one of a fight/left steering cylinder, a forward/reverse steering cylinder, and a pitch control cylinder.

6. The concrete finishing machine of claim 1, wherein the open loop cooler receives hydraulic fluid from a case drain of the hydrostatic drive system.

7. The concrete finishing machine of claim 1, further comprising a bypass valve that permits hydraulic fluid flowing out of the hydrostatic drive system to bypass the open loop cooler when the hydraulic fluid temperature is beneath a designated value.

8. A concrete finishing trowel, comprising:

(A) a frame;

(B) at least first and second rotor assemblies extending downwardly from the frame, each of the rotor assemblies having a shaft that supports a plurality of blades;

(C) an engine; and (D) a hydraulic circuit including (1) a reservoir, (2) a hydrostatic drive system that is coupled to the engine, to the rotor assemblies, and to the reservoir, the hydrostatic drive system comprising including (a) a first hydraulic drive motor that is coupled to the first rotor assembly, (b) a first drive pump that is driven by the engine and that delivers pressurized fluid to the first drive motor, (c) a second hydraulic drive motor that is coupled to the second rotor assembly, (d) a second drive pump that is driven by the engine and that delivers pressurized fluid to the second drive motor, and (e) a charge pump that is connected to the reservoir and that delivers hydraulic fluid to the first and second drive pumps;

(3) a closed loop oil cooler located in a flow path connecting outlets of the first and second drive motors to inlets of the first and second drive pumps; and (4) an open loop oil cooler in a flow path connecting the hydrostatic drive system to the reservoir.

9. The concrete finishing trowel of claim 8, further comprising an auxiliary pump and an auxiliary circuit that selectively couples hydraulically actuated devices of the concrete finishing trowel to the auxiliary pump and to a drain flow path, and wherein the drain flow path is fluidically coupled to an inlet of the open loop oil cooler.

10. The concrete finishing trowel of claim 8, wherein the open loop oil cooler receives hydraulic fluid from a case drain of the hydrostatic drive system.

11. The concrete finishing trowel of claim 8, further comprising a bypass valve that permits hydraulic fluid flowing out of the hydrostatic drive system to bypass the open loop oil cooler when the hydraulic fluid temperature is beneath a designated value.

12. A method of operating a hydrostatically driven concrete finishing machine, the concrete finishing machine having an engine and first and second rotatable rotor assemblies that support the concrete finishing machine on a surface to be finished, the method comprising:

driving a drive pump of a hydrostatic drive system via operation of the engine, delivering pressurized hydraulic fluid to a drive motor of the hydrostatic drive system from the drive pump, thereby causing the drive motor to drive at least one of the rotor assemblies to rotate;

delivering hydraulic fluid from the drive motor to the drive pump;

draining leakage hydraulic fluid from the hydrostatic drive system;

using a charge pump, pumping make-up hydraulic fluid to the hydrostatic drive system;

cooling hydraulic fluid flowing through the hydrostatic drive system in first and second coolers, wherein the cooling step comprises cooling hydraulic fluid within a closed loop circuit of the hydrostatic drive system via the first cooler and cooling hydraulic fluid drained from the hydrostatic drive system via the second cooler.

13. The method of claim 12, wherein the cooling step maintains the temperature of hydraulic fluid within the hydrostatic drive system beneath 200° F. throughout at least substantially an entire operating range of the concrete finishing machine.

14. The method of claim 12, further comprising controlling hydraulic fluid flow to and from hydraulically actuated devices of the concrete finishing machine via operation of an auxiliary hydraulic circuit, and further comprising cooling hydraulic fluid flowing from the auxiliary hydraulic circuit via the second cooler.

15. The method of claim 12, wherein the drive motor is a first drive motor coupled to the first rotor assembly and the drive pump is a first drive pump that delivers pressurized fluid to the first drive motor to drive the first rotor assembly to rotate, and further comprising:

driving a second drive pump of the hydrostatic drive system via operation of the engine, delivering pressurized hydraulic fluid to a second drive motor of the hydrostatic drive system from the second drive pump, thereby causing the second drive motor to drive the second rotor assembly to rotate; and delivering hydraulic fluid from the second drive motor to the second drive pump.

16. The method of claim 15, wherein the first cooler is located in a shared flow path coupling outlets of both of the first and second drive motors to inlets of both of the first and second drive pumps.

17. The method of claim 12, further comprising causing fluid draining from the hydrostatic drive system to bypass the second cooler if the temperature of the hydraulic fluid is beneath a designated temperature.

* * * * *